US012441377B2

(12) United States Patent
Morgart et al.

(10) Patent No.: US 12,441,377 B2
(45) **Date of Patent: *Oct. 14, 2025**

(54) SYSTEMS AND METHODS FOR IDENTIFYING POTENTIAL DEFICIENCIES IN RAILWAY ENVIRONMENT OBJECTS

(71) Applicant: BNSF Railway Company, Fort Worth, TX (US)

(72) Inventors: Dennis William Morgart, Topeka, KS (US); Joshua J. McBain, Lawrence, KS (US); Corey Tremain Pasta, Topeka, KS (US); Aaron Thomas Ratledge, Haslet, TX (US)

(73) Assignee: BNSF Railway Company, Fort Worth, TX (US)

( * ) Notice: Subject to any disclaimer, the term of this patent is extended or adjusted under 35 U.S.C. 154(b) by 4 days.

This patent is subject to a terminal disclaimer.

(21) Appl. No.: 18/444,876

(22) Filed: Feb. 19, 2024

(65) Prior Publication Data

US 2024/0190485 A1 Jun. 13, 2024

Related U.S. Application Data

(63) Continuation of application No. 16/827,238, filed on Mar. 23, 2020, now Pat. No. 11,904,914.

(51) Int. Cl.
*B61L 23/04* (2006.01)
*B61L 15/00* (2006.01)
(Continued)

(52) U.S. Cl.
CPC ..... *B61L 23/041* (2013.01); *B61L 15/0072* (2013.01); *B61L 15/0081* (2013.01);
(Continued)

(58) Field of Classification Search
CPC ..... B61L 23/041; B61L 15/0072; B61L 15/0081; B61L 15/0094; B61L 23/007;
(Continued)

(56) References Cited

U.S. PATENT DOCUMENTS 7,999,848 B2 * 8/2011 Chew ..... B61L 23/041 348/148
2015/0009331 A1 * 1/2015 Venkatraman ..... B61L 27/53 348/148
(Continued)

FOREIGN PATENT DOCUMENTS

CN 105398471 A * 3/2016 ..... B61L 23/048
WO 2019244425 A1 12/2019

OTHER PUBLICATIONS

Patent Cooperation Treaty, International Search Report and Written Opinion, International Application No. PCT/US2021/021613.

*Primary Examiner* — Zachary L Kuhfuss
(74) *Attorney, Agent, or Firm* — Whitaker Chalk Swindle & Schwartz PLLC; Enrique Sanchez, Jr.; Bradley J. Birchfield

(57) ABSTRACT

In one embodiment, a method includes capturing, by a machine vision device, an image of an object in a railway environment. The machine vision device is attached to a first train car that is moving in a first direction along a first railroad track of the railway environment. The method also includes analyzing, by the machine vision device, the image of the object using one or more machine vision algorithms to determine a value associated with the object. The method further includes determining, by the machine vision device, that the value associated with the object indicates a potential deficiency of the object and communicating, by the machine vision device, an alert to a component external to the first train car. The alert comprises an indication of the potential deficiency of the object.

20 Claims, 5 Drawing Sheets

(51) Int. Cl.
*B61L 23/00* (2006.01)
*B61L 27/40* (2022.01)

(52) U.S. Cl.
CPC ..... *B61L 15/0094* (2024.01); *B61L 23/007* (2013.01); *B61L 23/042* (2013.01); *B61L 23/044* (2013.01); *B61L 23/047* (2013.01); *B61L 23/048* (2013.01); *B61L 27/40* (2022.01)

(58) Field of Classification Search
CPC .... B61L 23/042; B61L 23/044; B61L 23/047; B61L 23/048; B61L 27/40; B61K 9/08
See application file for complete search history.

(56) References Cited

U.S. PATENT DOCUMENTS

| | | | | |
|---|---|---|---|---|
| 2016/0200330 | A1* | 7/2016 | Palmer | B61L 27/57 701/29.1 |
| 2019/0054937 | A1* | 2/2019 | Graetz | B61L 23/048 |
| 2019/0146520 | A1* | 5/2019 | Naithani | B61L 23/042 701/28 |
| 2021/0078622 | A1 | 3/2021 | Miller et al. | |

* cited by examiner

SYSTEMS AND METHODS FOR IDENTIFYING POTENTIAL DEFICIENCIES IN RAILWAY ENVIRONMENT OBJECTS

CROSS-REFERENCE TO RELATED APPLICATIONS

The present application is a Continuation Application of U.S. patent application Ser. No. 16/827,238, filed Mar. 23, 2020, the contents of which are incorporated herein in their entireties for all purposes.

TECHNICAL FIELD

This disclosure generally relates to identifying deficiencies in objects, and more specifically to systems and methods for identifying potential deficiencies in railway environment objects.

BACKGROUND

Traditionally, railroad inspectors inspect railroads for unsafe conditions and recommend actions to correct the unsafe conditions. For example, a railroad inspector may encounter a buckled railroad track and report the buckled railroad track to a railroad company. In response to receiving the report, the railroad company may take action to repair the buckled railroad track. However, the corrective action may not be performed in time to prevent the occurrence of an accident such as a train derailment.

SUMMARY

According to an embodiment, a method includes capturing, by a machine vision device, an image of an object in a railway environment. The machine vision device is attached to a first train car that is moving in a first direction along a first railroad track of the railway environment. The method also includes analyzing, by the machine vision device, the image of the object using one or more machine vision algorithms to determine a value associated with the object. The method further includes determining, by the machine vision device, that the value associated with the object indicates a potential deficiency of the object and communicating, by the machine vision device, an alert to a component external to the first train car. The alert comprises an indication of the potential deficiency of the object.

In certain embodiments, the potential deficiency of the object is one of the following: a misalignment of a second railroad track; a malfunction of a crossing warning device; an obstructed view of a second railroad track; damage to the object; or a misplacement of the object. In some embodiments, the first railroad track of the railway environment is adjacent to a second railroad track of the railway environment, the component external to the first train car is attached to a second train car that is moving in a second direction along the second railroad track, and the alert instructs the second train car to perform an action. In certain embodiments, the component external to the first train car is a device located within a network operations center.

In some embodiments, the alert includes at least one of the following: a description of the object; a description of the potential deficiency; the image of the object; a location of the object; a time when the object was captured by the machine vision device of the first train car; a date when the object was captured by the machine vision device of the first train car; an identification of the first train car; an indication of the first direction of the first train car; and an indication of one or more train cars that are scheduled to pass through the railway environment within a predetermined amount of time. In certain embodiments, the machine vision device captures the image of the object and communicates the alert to the component external to the first train car in less than ten seconds. The machine vision device may be mounted to a front windshield of the first train car.

According to another embodiment, a system includes one or more processors and a memory storing instructions that, when executed by the one or more processors, cause the one or more processors to perform operations including capturing, by a machine vision device, an image of an object in a railway environment. The machine vision device is attached to a first train car that is moving in a first direction along a first railroad track of the railway environment. The operations also include analyzing the image of the object using one or more machine vision algorithms to determine a value associated with the object. The operations further include determining that the value associated with the object indicates a potential deficiency of the object and communicating an alert to a component external to the first train car. The alert comprises an indication of the potential deficiency of the object.

According to yet another embodiment, one or more computer-readable storage media embody instructions that, when executed by a processor, cause the processor to perform operations including capturing, by a machine vision device, an image of an object in a railway environment. The machine vision device is attached to a first train car that is moving in a first direction along a first railroad track of the railway environment. The operations also include analyzing the image of the object using one or more machine vision algorithms to determine a value associated with the object. The operations further include determining that the value associated with the object indicates a potential deficiency of the object and communicating an alert to a component external to the first train car. The alert comprises an indication of the potential deficiency of the object.

Technical advantages of certain embodiments of this disclosure may include one or more of the following. Certain systems and methods described herein include a machine vision device that analyzes railway environments for safety critical aspects such as track misalignments, malfunctioning warning devices, obstructed views of railroad tracks, pedestrians near railroad tracks, and washouts. In certain embodiments, the machine vision device detects and reports potential deficiencies in railway environments in real-time, which may lead to immediate corrective action and the reduction/prevention of accidents. In some embodiments, the machine vision device automatically detects deficiencies in railway environments, which may reduce costs and/or safety hazards associated with on-site inspectors.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

To assist in understanding the present disclosure, reference is now made to the following description taken in conjunction with the accompanying drawings, in which.

DETAILED DESCRIPTION

Figure 1:
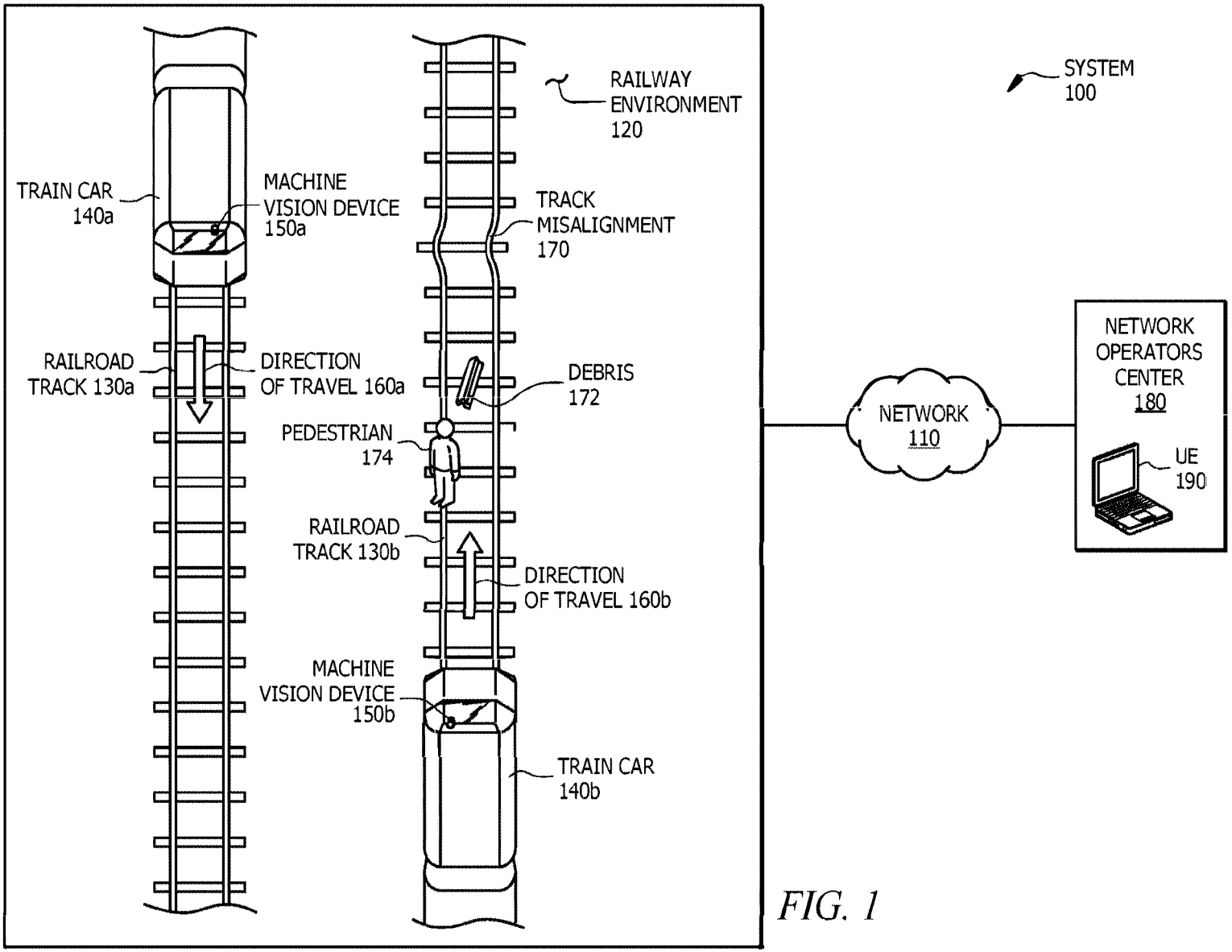
FIG. 1 illustrates an example system for identifying potential deficiencies in railway environment objects.
Figure 2:
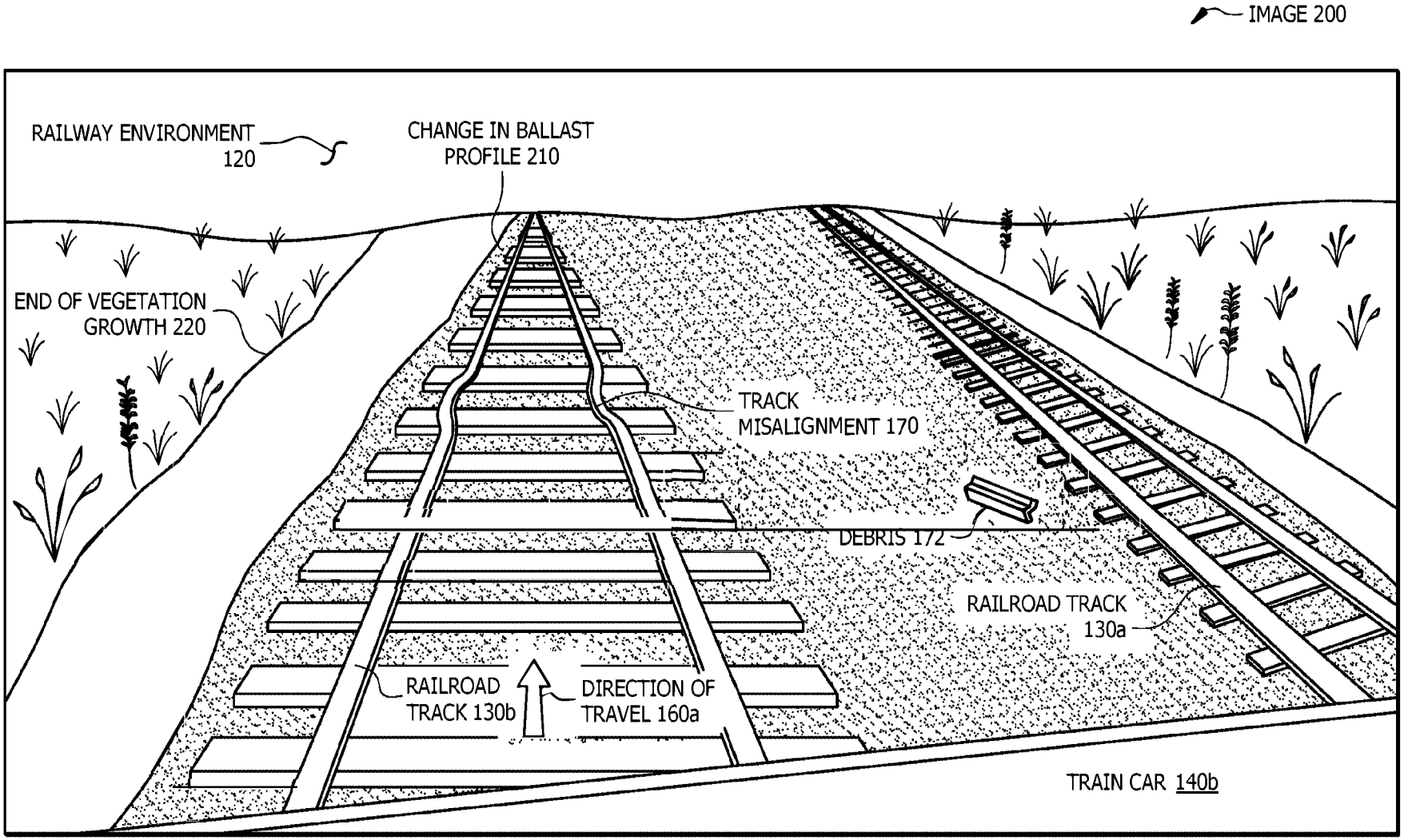
FIG. 2 illustrates an example forward-facing image that may be generated by a machine vision device of the system of FIG. 1.
Figure 3:
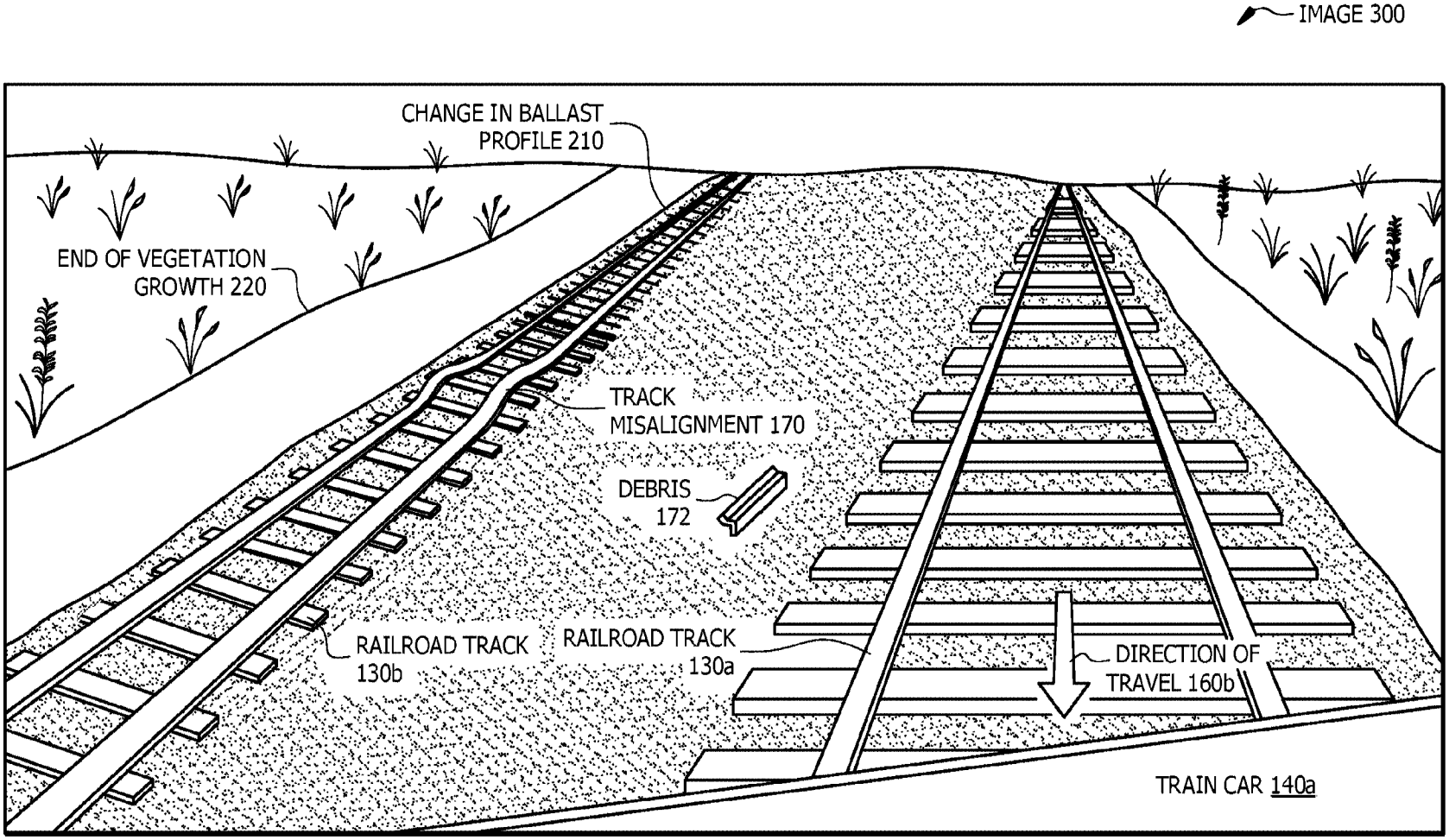
FIG. 3 illustrates an example rear-facing image that may be generated by the machine vision device of the system of FIG. 1.
Figure 4:
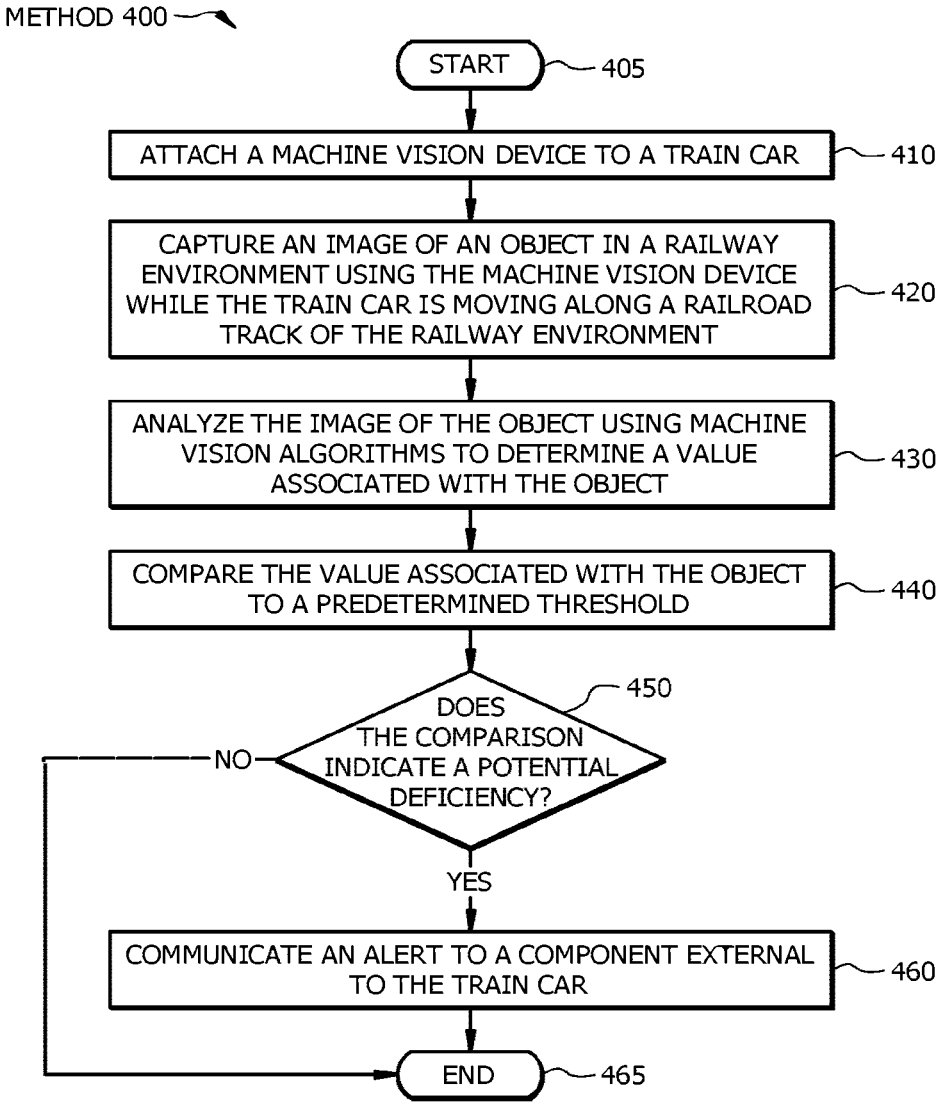
FIG. 4 illustrates an example method for identifying potential deficiencies in railway environment objects.
Figure 5:
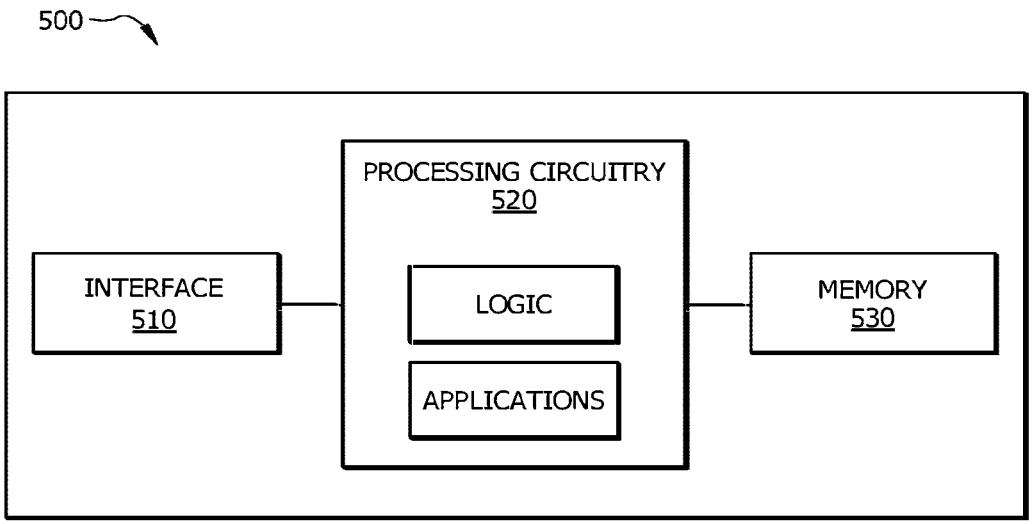
FIG. 5 illustrates an example computer system that may be used by the systems and methods described herein.

FIGS. 1 through 5 show example systems and methods for identifying potential deficiencies in railway environment objects. FIG. 1 shows an example system for identifying potential deficiencies in railway environment objects. FIG. 2 shows an example forward-facing image that may be generated by a machine vision device of the system of FIG. 1, and FIG. 3 shows an example rear-facing image that may be generated by a machine vision device of the system of FIG. 1. FIG. 4 shows an example method for identifying potential deficiencies in railway environment objects. FIG. 5 shows an example computer system that may be used by the systems and methods described herein.

FIG. 1 illustrates an example system 100 for identifying potential deficiencies in railway environment objects. System 100 of FIG. 1 includes a network 110, a railway environment 120, railroad tracks 130 (i.e., railroad track 130*a* and railroad track 130*b*), train cars 140 (i.e., train car 140*a* and train car 140*b*), machine vision devices 150 (i.e., machine vision device 150*a* and machine vision device 150*b*), a network operations center 180, and user equipment (UE) 190. System 100 or portions thereof may be associated with an entity, which may include any entity, such as a business, company (e.g., a railway company, a transportation company, etc.), or a government agency (e.g., a department of transportation, a department of public safety, etc.) that may identify potential deficiencies in railway environment objects. While the illustrated embodiment of FIG. 1 is associated with a railroad system, system 100 may be associated with any suitable transportation system (e.g., vehicles/roadways, vessels/waterways, and the like). The elements of system 100 may be implemented using any suitable combination of hardware, firmware, and software. For example, one or more components of system 100 may use one or more components of FIG. 5.

Network 110 of system 100 may be any type of network that facilitates communication between components of system 100. For example, network 110 may connect machine vision device 150*a* to machine vision device 150*b* of system 100. As another example, network 110 may connect machine vision devices 150 to UE 190 of network operations center 180 of system 100. One or more portions of network 110 may include an ad-hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, a 3G network, a 4G network, a 5G network, a Long Term Evolution (LTE) cellular network, a combination of two or more of these, or other suitable types of networks. One or more portions of network 110 may include one or more access (e.g., mobile access), core, and/or edge networks. Network 110 may be any communications network, such as a private network, a public network, a connection through Internet, a mobile network, a WI-FI network, a Bluetooth network, etc. Network 110 may include cloud computing capabilities. One or more components of system 100 may communicate over network 110. For example, machine vision devices 150 may communicate over network 110, including transmitting information (e.g., potential deficiencies) to UE 190 of network operations center 180 and/or receiving information (e.g., confirmed deficiencies) from UE 190 of network operations center 180.

Railway environment 120 of system 100 is an area that includes one or more railroad tracks 130. Railway environment 120 may be associated with a division and/or a subdivision. The division is the portion of the railroad under the supervision of a superintendent. The subdivision is a smaller portion of the division. The subdivision may be a crew district and/or a branch line. In the illustrated embodiment of FIG. 1, railway environment 120 includes railroad tracks 130, train cars 140, and machine vision devices 150.

Railroad tracks 130 of system 100 are structures that allow train cars 140 to move by providing a surface for the wheels of train cars 140 to roll upon. In certain embodiments, railroad tracks 130 include rails, fasteners, railroad ties, ballast, etc. Train cars 140 are vehicles that carry cargo and/or passengers on a rail transport system. In certain embodiments, train cars 140 are coupled together to form trains. Train cars 140 may include locomotives, passenger cars, freight cars, boxcars, flatcars, tank cars, and the like.

In the illustrated embodiment of FIG. 1, train cars 140 include train car 140*a* and train car 140*b*. Train car 140*a* is moving in direction of travel 160*a* along railroad track 130*a*. Train car 140*b* is moving in direction of travel 160*b* along railroad track 130*b*. In some embodiments, railroad track 130*a* of railway environment 120 is adjacent (e.g., parallel) to railroad track 130*b* of railway environment 120. In certain embodiments, direction of travel 160*a* is opposite from direction of travel 160*b*. For example, direction of travel 160*a* may be southbound, and direction of travel 160*b* may be northbound. As another example, direction of travel 160*a* may be eastbound, and direction of travel 160*b* may be westbound.

Machine vision devices 150 of system 100 are components that automatically capture, inspect, evaluate, and/or process still or moving images. Machine vision devices 150 may include one or more cameras, lenses, sensors, optics, lighting elements, etc. In certain embodiments, machine vision devices 150 perform one or more actions in real-time or near real-time. For example, machine vision device 150*a* of train car 140*a* may capture an image of an object (e.g., railroad track 130*b*) of railway environment 120 and communicate an alert indicating a potential deficiency (e.g., track misalignment 170) to a component (e.g., machine vision device 150*b* or UE 190 of network operations center 180) external to train car 140*a* in less than a predetermined amount of time (e.g., one, five, or ten seconds).

In certain embodiments, machine vision devices 150 include one or more cameras that automatically capture images of railway environment 120 of system 100. Machine vision devices 150 may automatically capture still or moving images while train cars 140 are moving along railroad tracks 130. Machine vision devices 150 may automatically capture any suitable number of still or moving images. For example, machine vision devices 150 may automatically capture a predetermined number of images per second, per minute, per hour, etc. In certain embodiments, machine vision devices 150 automatically capture a sufficient number of images to capture the entire lengths of railroad tracks 130 within a predetermined area (e.g., a division or subdivision).

Machine vision device 150*a* of system 100 is attached to train car 140*a*. Machine vision device 150*a* may be attached to train car 140*a* in any suitable location that provides a clear view of railroad track 130*a*. For example, machine vision device 150*a* may be attached to a front end (e.g., front windshield) of train car 140*a* to provide a forward-facing view of railroad track 130*a*. As another example, machine vision device 150*a* may be attached to a back end (e.g., a back windshield) of train car 140*a* to provide a rear-facing view of railroad track 130*a*. In certain embodiments, machine vision device 150*a* captures images of railway environment 120 as train car 140*a* moves along railroad track 130*a* in direction of travel 160*a*.

Machine vision device 150*b* of system 100 is attached to train car 140*b*. Machine vision device 150*b* may be attached to train car 140*b* in any suitable location that provides a clear view of railroad track 130*b*. For example, machine vision device 150*b* may be attached to a front end (e.g., front windshield) of train car 140*b* to provide a forward-facing view of railroad track 130*b*. As another example, machine vision device 150*b* may be attached to a back end (e.g., a back windshield) of train car 140*b* to provide a rear-facing view of railroad track 130*b*. In certain embodiments, machine vision device 150*b* captures images of railway environment 120 as train car 140*b* moves along railroad track 130*b* in direction of travel 160*b*.

Machine vision devices 150 may inspect the captured images for objects. The objects may include railroad tracks 130, debris 172 (e.g., rubble, wreckage, ruins, litter, trash, brush, etc.), pedestrians 174 (e.g., trespassers), animals, vegetation, ballast, and the like. In some embodiments, machine vision devices 150 may use machine vision algorithms to analyze the objects in the images. Machine vision algorithms may recognize objects in the images and classify the objects using image processing techniques and/or pattern recognition techniques.

In certain embodiments, machine vision devices 150 use machine vision algorithms to analyze the objects in the images for exceptions. Exceptions are deviations in the object as compared to an accepted standard. Exceptions may include track misalignment (e.g., a curved, warped, twisted, or offset track) of one or more railroad tracks 130 (e.g., track misalignment 170 of railroad track 130*b*), debris 172 exceeding a predetermined size that is located on one or more railroad tracks 130 or within a predetermined distance of one or more railroad tracks 130, a pedestrian 174 (e.g., a trespasser) located on or within a predetermined distance of railroad tracks 130, a malfunction of a crossing warning device, an obstructed view of railroad tracks 130, damage to the object (e.g., a washout of the support surface of one or more railroad tracks 130), misplacement of the object, and the like.

In some embodiments, machine vision devices 150 may determine a value associated with the object and compare the value with a predetermined threshold (e.g., a predetermined acceptable value) to determine whether the object presents an exception. For example, machine vision device 150 may determine that track misalignment 170 of railroad track 130*b* of FIG. 1 extends three meters and compare that value with an acceptable track misalignment value of one meter to determine that track misalignment 170 presents an exception. As another example, machine vision device 150 may determine that debris 172 of FIG. 1 is located on railroad track 130*b* and compare that value with an acceptable value of debris 172 being located greater three meters away from railroad track 130*b* to determine that debris 172 presents an exception. As still another example, machine vision device 150 may determine that pedestrian 174 of FIG. 1 is located on railroad track 130*b* and compare that value with an acceptable value of pedestrian 174 being located greater three meters away from railroad track 130*b* to determine that pedestrian 174 presents an exception. In certain embodiments, an exception indicates a potential deficiency of the object.

Machine vision devices 150 may communicate one or more alerts to one or more components of system 100. The alerts may include indications of the exceptions (e.g., deficiencies) determined by machine vision devices 150. In certain embodiments, machine vision device 150*a* of FIG. 1 communicates one or more alerts to machine device 150*b* of FIG. 1. For example, machine vision device 150*a* of train car 140*a* may capture an image of track misalignment 170 of railroad track 130*b*, determine that the track misalignment 170 is an exception, and communicate an alert indicating the exception to one or more components of train car 140*b* (e.g., machine vision device 150*b*). The alert may inform the train engineer of train car 140*b* of track misalignment 170 prior to train car 140*b* encountering track misalignment 170.

In certain embodiments, alerts generated by machine vision devices 150 may include one or more of the following: a description of the object (e.g., railroad track 130*b*); a description of the potential deficiency (e.g., track misalignment 170); the image of the object; a location of the object (e.g., a Global Positioning System (GPS) location of track misalignment 170 of railroad track 130*b*); a time when the object was captured by machine vision device 150 of train car 140; a date when the object was captured by machine vision device 150 of train car 140; an identification of train car 140 (e.g., train car 140*a* or train car 140*b*); an indication of direction of travel 160 of train car 140; an indication of one or more train cars that are scheduled to pass through railway environment 120 within a predetermined amount of time, and the like. In some embodiments, machine vision device 150*a* of FIG. 1 communicates one or more exceptions to UE 190 of network operations center 180.

Network operations center 180 of system 100 is a facility with one or more locations that houses support staff who manage transportation-related traffic. For example, network operations center 180 may monitor, manage, and/or control the movement of trains across states, providences, and the like. Network operations center 180 may include transportation planning technology to facilitate collaboration between employees associated with network operations center 180. The employees may include dispatchers (e.g., a train dispatchers), support staff, crew members, engineers (e.g., train engineers), team members (e.g., security team members), maintenance planners, superintendents (e.g., corridor superintendents), field inspectors, and the like. In certain embodiments, network operations center 180 includes meeting rooms, televisions, workstations, and the like. Each workstation may include UE 190.

UE 190 of system 100 includes any device that can receive, create, process, store, and/or communicate information. For example, UE 190 of system 100 may receive information (e.g., a potential deficiency) from machine vision device 150 and/or communicate information (e.g., a confirmed deficiency) to machine vision device 150. UE 190 may be a desktop computer, a laptop computer, a mobile phone (e.g., a smart phone), a tablet, a personal digital assistant, a wearable computer, and the like. UE 190 may include a liquid crystal display (LCD), an organic light-emitting diode (OLED) flat screen interface, digital buttons, a digital keyboard, physical buttons, a physical keyboard, one or more touch screen components, a graphical user interface (GUI), and the like. While UE 190 is located within network operations center 180 in the illustrated embodiment of FIG. 1, UE 190 may be located in any suitable location to receive and communicate information to one or more components of system 100. For example, an employee of network operations center 180 may be working remotely at a location such as a residence or a retail store, and UE 190 may be situated at the location of the employee of network operations center 180. As another example, UE 190 may be located in one or more train cars 140.

In operation, machine vision device 150*a* is attached to train car 140*a* and machine vision device 150*b* is attached to train car 140*b*. Train car 140*a* is moving along railroad track 130*a* in southbound direction of travel 160*a*. Train car 140*b* is moving along railroad track 130*b* in northbound direction of travel 160*b*. Train car 140*a* enters railway environment 120 at time T1, and train car 140*b* is scheduled to enter railway environment 120 at a later time T2 (e.g., ten minutes after time T1). Machine vision device 150*a* captures an image of railway environment 120 at time T1 that includes railroad track 130*b*. Machine vision device 150*a* analyzes the image of railroad track 130*b* using one or more machine vision algorithms to determine a value associated with an alignment of railroad track 130*b*. Machine vision device 150*a* compares the alignment value to a predetermined acceptable alignment value and determines that the alignment value exceeds the predetermined acceptable alignment value. Machine vision device 150*a* determines, based on the comparison, that railroad track 130*b* includes a potential deficiency. Machine vision device 150*a* communicates an alert that includes an identification and a location of the potential deficiency to UE 190 of network operations center 180. A user of UE 190 confirms that the potential deficiency is an actual deficiency and communicates the identification and location of track misalignment 170 to machine vision device 150*b* of train car 140*b* prior to train car 140*b* encountering track misalignment 170. As such, system 100 may be used to alert a train of a dangerous condition in an upcoming railway environment, which may allow the train enough time to initiate an action that avoids the dangerous condition.

Although FIG. 1 illustrates a particular arrangement of network 110, railway environment 120, railroad tracks 130, train cars 140, machine vision devices 150, network operations center 180, and UE 190, this disclosure contemplates any suitable arrangement of network 110, railway environment 120, railroad tracks 130, train cars 140, machine vision devices 150, network operations center 180, and UE 190. For example, track misalignment 170 may be located on railroad track 130*a* instead of railroad track 130*b*. As another example, machine vision device 150*a* may be located on a rear portion of train car 140*a* instead of on the front portion of train car 140*a*. As still another example, debris 172 and/or pedestrian 174 may be located in between railroad track 130*a* and railroad track 130*b*.

Although FIG. 1 illustrates a particular number of networks 110, railway environments 120, railroad tracks 130, train cars 140, machine vision devices 150, network operations centers 180, and UEs 190, this disclosure contemplates any suitable number of networks 110, railway environments 120, railroad tracks 130, train cars 140, machine vision devices 150, network operations centers 180, and UEs 190. For example, FIG. 1 may include more or less than two railroad tracks 130 and/or more or less than two train cars 140.

FIG. 2 illustrates an example forward-facing image 200 that may be generated by machine vision device 150*b* of system 100 of FIG. 1. Image 200 shows an overview of railway environment 120 at a particular moment in time. Image 200 includes railroad track 130*a*, railroad track 130*b*, track misalignment 170 on railroad track 130*b*, debris 172 between railroad track 130*a* and railroad track 130*b*, a change in ballast profile 210 near railroad track 130*b*, and an end of vegetation growth 220 outside of railroad track 130*b*. In the illustrated embodiment of FIG. 2, railroad track 130*a* is adjacent (e.g., parallel) to railroad track 130*b*.

In certain embodiments, machine vision device 150*b* of FIG. 1 automatically captures image 200 of FIG. 2 as train car 140*b* moves along railroad track 130*b* in direction of travel 160*a*. Machine vision device 150*b* may capture image 200 as a still or moving image. In the illustrated embodiment of FIG. 2, machine vision device 150*b* is attached to a front windshield of train car 140*b* to provide a clear, forward-facing view of railroad track 130*b*.

In some embodiments, machine vision device 150*b* automatically processes image 200 to identify one or more objects in image 200. Machine vision device 150*b* may use machine learning algorithms and/or machine vision algorithms to process image 200. In certain embodiments, machine vision device 150*b* automatically processes image 200 in real-time or in near real-time. In the illustrated embodiment of FIG. 2, the identified objects include railroad track 130*a*, railroad track 130*b*, debris 172 between railroad track 130*a* and railroad track 130*b*, ballast 210, and vegetation 220 outside of railroad track 130*b*. Machine vision device 150*b* analyzes the objects in image 200 to determine whether image 200 includes one or more exceptions (e.g., deficiencies).

In certain embodiments, machine vision device 150*b* automatically identifies one or more exceptions in image 200. For example, machine vision device 150*b* may capture image 200 of railroad track 130*b*, identify an exception (e.g., a curvature) in railroad track 130*b* of image 200, and use one or more algorithms to classify the exception as a potential deficiency (e.g., track misalignment 170). As another example, machine vision device 150*b* may capture image 200 of debris 172, identify an exception (e.g., debris 172 located too close to railroad track 130*a*, debris 172 obstructing a view of railroad track 130*a*, etc.) for debris 172 of image 200, and use one or more algorithms to classify the exception as a deficiency (e.g., a potential hazard to an oncoming train).

In some embodiments, machine vision device 150*b* generates one or more labels for image 200. The labels represent information associated with image 200. For example, machine vision device 150*b* may generate one or more labels for image 200 that identify one or more objects (e.g., railroad track 130*b*, debris 172, etc.). As another example, machine vision device 150*b* may generate one or more labels for image 200 that identify one or more potential deficiencies within image 200 (e.g., track misalignment 170, change in ballast profile 210, etc.). As still another example, machine vision device 150*b* may generate one or more labels for image 200 that provide additional information for image 200 (e.g., direction of travel 160*a*, end of vegetation growth 220, etc.). In some embodiments, machine vision device 150*b* superimposes one or more labels on image 200.

In certain embodiments, machine vision device 150*b* communicates image 200 to one or more external components (e.g., UE 190 of network operations center 180 of FIG. 1). In some embodiments, machine vision device 150*b* may identify exceptions (e.g., deficiencies) in image 200 prior to train car 140*b* encountering the exception. For example, machine vision device 150*b* may capture image 200 as train car 140*b* approaches track misalignment 170 of railroad track 130*b*. Machine vision device 150*b* may automatically determine that image 200 includes track misalignment 170 and alert an operator of train car 140*b* of the potential danger. In response to the alert, the operator may take an action (e.g., stop or slow down the train associated with train car 140*b*) prior to train car 140*b* encountering track misalignment 170, which may prevent an accident (e.g., a train derailment). As such, image 200 may be used to identify potential deficiencies in railway environment 120, which may increase safety operations within railway environment 120.

Although FIG. 2 illustrates a particular arrangement of railroad track 130*a*, railroad track 130*b*, track misalignment 170, debris 172, ballast profile 210, and vegetation growth 220 of image 200, this disclosure contemplates any suitable arrangement of railroad track 130*a*, railroad track 130*b*, track misalignment 170, debris 172, ballast profile 210, and vegetation growth 220 of image 200. For example, railroad track 130*a* and railroad track 130*b* may be switched. As another example, debris 172 may be located on railroad track 130*a*, on railroad track 130*b*, or near railroad track 130*b*.

Although FIG. 2 illustrates a particular number of images 200, railroad tracks 130*a*, railroad tracks 130*b*, track misalignments 170, debris 172, ballast profiles 210, and vegetation growths 220, this disclosure contemplates any suitable number of images 200, railroad tracks 130*a*, railroad tracks 130*b*, track misalignments 170, debris 172, ballast profiles 210, and vegetation growths 220. For example, FIG. 2 may include more or less than two railroad tracks. While image 200 of FIG. 2 is associated with a railroad system, image 200 may be associated with any suitable transportation system (e.g., vehicles/roadways, vessels/waterways, and the like).

FIG. 3 illustrates an example rear-facing image 300 that may be generated by machine vision device 150*a* of system 100 of FIG. 1. Image 300 shows an overview of railway environment 120 at a particular moment in time. Image 300 includes railroad track 130*a*, railroad track 130*b*, track misalignment 170 on railroad track 130*b*, debris 172 between railroad track 130*a* and railroad track 130*b*, a change in ballast profile 210 near railroad track 130*b*, and an end of vegetation growth 220. In the illustrated embodiment of FIG. 3, railroad track 130*a* is adjacent (e.g., parallel) to railroad track 130*b*.

In certain embodiments, machine vision device 150*a* of FIG. 1 automatically captures image 300 of FIG. 3 as train car 140*a* of FIG. 1 moves along railroad track 130*a* in direction of travel 160*b*. Machine vision device 150*a* may capture image 300 as a still or moving image. In certain embodiments, machine vision device 150*a* is attached to a rear windshield of train car 140*b* to provide a clear, rear-facing view of railroad track 130*a* and railroad track 130*b*.

In some embodiments, machine vision device 150*a* automatically processes image 300 to identify one or more objects in image 300. Machine vision device 150*a* may use machine learning algorithms and/or machine vision algorithms to process image 300. In certain embodiments, machine vision device 150*a* automatically processes image 300 in real-time or in near real-time. In the illustrated embodiment of FIG. 3, the identified objects include railroad track 130*a*, railroad track 130*b*, debris 172 between railroad track 130*a* and railroad track 130*b*, ballast 210, and vegetation 220. Machine vision device 150*a* analyzes the objects in image 300 to determine whether image 300 includes one or more exceptions (e.g., deficiencies).

In certain embodiments, machine vision device 150*a* automatically identifies one or more exceptions in image 300. For example, machine vision device 150*a* may capture image 300 of railroad track 130*b*, identify an exception (e.g., a curved, buckled, warped, and/or twisted rail) in railroad track 130*b* of image 300, and use one or more algorithms to classify the exception as a deficiency (e.g., a track misalignment 170). As another example, machine vision device 150*a* may capture image 300 of debris 172, identify an exception (e.g., debris 172 located too close to railroad track 130*b*, debris 172 obstructing a view of railroad track 130*b*, etc.) for debris 172 of image 300, and use one or more algorithms to classify the exception as a deficiency (e.g., a potential hazard to an oncoming train).

In some embodiments, machine vision device 150*a* generates one or more labels on image 300. For example, machine vision device 150*a* may generate one or more labels on image 300 that identify one or more objects (e.g., railroad track 130*a*, railroad track 130*b*, debris 172, etc.). As another example, machine vision device 150*a* may generate one or more labels on image 300 that identify one or more potential deficiencies within image 300 (e.g., track misalignment 170, change in ballast profile 210, etc.). As still another example, machine vision device 150*a* may generate one or more labels on image 300 that provide additional information for image 300 (e.g., direction of travel 160*b*, end of vegetation growth 220, etc.). In some embodiments, machine vision device 150*b* superimposes one or more labels on image 300.

In certain embodiments, machine vision device 150*a* communicates image 300 to one or more components (e.g., UE 190 of network operations center 180 of FIG. 1, machine vision device 150*b* of FIG. 1, etc.). In some embodiments, machine vision device 150*a* may identify exceptions (e.g., deficiencies) in image 300 prior to other train cars encountering the exceptions. For example, machine vision device 150*a* may capture image 300 as train car 140*a* travels along railroad track 130*a* and passes by track misalignment 170 of railroad track 130*b*. Machine vision device 150*b* may automatically determine that image 300 includes track misalignment 170 of railroad track 130*b* and communicate an alert to a component (e.g., machine vision device 150*b*) of train car 140*b*. An operator of train car 140*b* may receive the alert indicating the potential danger of track misalignment 170. In response to the alert, the operator may take an action (e.g., stop or slow down the train associated with train car 140*b*) prior to train car 140*b* encountering track misalignment 170, which may prevent an accident (e.g., a train derailment). As such, image 300 may be used to identify potential deficiencies in railway environment 120, which may increase safety operations within railway environment 120.

Although FIG. 3 illustrates a particular arrangement of railroad track 130*a*, railroad track 130*b*, track misalignment 170, debris 172, ballast profile 210, and vegetation growth 220 of image 300, this disclosure contemplates any suitable arrangement of railroad track 130*a*, railroad track 130*b*, track misalignment 170, debris 172, ballast profile 210, and vegetation growth 220 of image 300. For example, railroad track 130*a* and railroad track 130*b* may be switched. As another example, debris 172 may be located on railroad track 130*a*, on railroad track 130*b*, or near railroad track 130*b*.

Although FIG. 3 illustrates a particular number of images 300, railroad tracks 130*a*, railroad tracks 130*b*, track misalignments 170, debris 172, ballast profiles 210, and vegetation growths 220, this disclosure contemplates any suitable number of images 300, railroad tracks 130*a*, railroad tracks 130*b*, track misalignments 170, debris 172, ballast profiles 210, and vegetation growths 220. For example, FIG. 3 may include more or less than two railroad tracks. While image 300 of FIG. 3 is associated with a railroad system, image 300 may be associated with any suitable transportation system (e.g., vehicles/roadways, vessels/waterways, and the like).

FIG. 4 illustrates an example method 400 for identifying potential deficiencies in railway environment objects. Method 400 begins at step 405. At step 410, a machine vision device (e.g., machine vision device 150*a* of FIG. 1) is attached to a train car (e.g., train car 140*a* of FIG. 1). In certain embodiments, the train car is located at the end of a train, and the machine vision device is attached to a back windshield of the train car to provide a clear rear-view of the railroad track (e.g., railroad track 130*a* of FIG. 1). In certain embodiments, the machine vision device is positioned on the back windshield of the train car to provide a clear rear-view of adjacent railroad tracks (e.g., railroad track 130*b* of FIG. 1). Method 400 then moves from step 410 to step 420.

At step 420 of method 400, the machine vision device captures an image (e.g., image 300 of FIG. 3) of an object in a railway environment (e.g., railway environment 120 of FIG. 1). For example, the machine vision device may capture an image of an adjacent railroad track (e.g., railroad track 130*b* of FIG. 1), debris (e.g., debris 172 of FIG. 1), and/or a pedestrian (e.g., pedestrian 174 of FIG. 1) in the railway environment. The machine vision device captures the image at time T1 while the train car is moving along the railroad track in a first direction (e.g., direction of travel 160*a* of FIG. 1). Method 400 then moves from step 420 to step 430.

At step 430 of method 400, the machine vision device analyzes the image of the object using one or more machine vision algorithms to determine a value associated with the object. For example, the machine vision device may analyze the image of the adjacent railroad track to determine a curvature value associated with the adjacent railroad track. As another example, the machine vision device may analyze the image of the debris to determine a size and/or shape value associated with the debris. As still another example, the machine vision device may analyze the image to determine a distance between the pedestrian and the adjacent railroad track. Method 400 then moves from step 430 to step 440.

At step 440 of method 400, the machine vision device compares the value associated with the object to a predetermined threshold. For example, the machine vision device may compare the curvature value associated with the adjacent railroad track to a predetermined curvature threshold. As another example, the machine vision device may compare the size and/or shape value associated with the debris to a predetermined size and/or shape threshold. As still another example, the machine vision device may compare the distance between the pedestrian and the adjacent railroad track to a predetermined distance threshold. Method 400 then moves from step 440 to step 450.

At step 450 of method 400, the machine vision device determines whether the comparison of the value associated with the object to the predetermined threshold indicates a potential deficiency of the object. In certain embodiments, the machine vision device may determine that the value associated with the object exceeds the predetermined threshold. For example, the machine vision device may determine that the curvature value associated with the adjacent railroad track exceeds the predetermined curvature threshold. As another example, the machine vision device may determine that the size and/or shape value associated with the debris exceeds the predetermined size and/or shape threshold. In certain embodiments, the machine vision device may determine that the value associated with the object is less than the predetermined threshold. For example, the machine vision device may determine that the distance (e.g., two feet) between the pedestrian and the adjacent railroad track is less than a predetermined threshold distance (e.g., five feet).

If, at step 450, the machine vision device determines that the comparison of the value associated with the object to the predetermined threshold does not indicate a potential deficiency of the object, method 400 advances from step 450 to step 465, where method 400 ends. If, at step 450, the machine vision device determines that the comparison of the value associated with the object to the predetermined threshold indicates a potential deficiency of the object, method 400 moves from step 450 to step 460, where the machine vision device communicates an alert to a component external to the train car. The alert may include one or more of the following: a description of the object; a description of the potential deficiency; the image of the object; a location of the object; a time when the object was captured by the machine vision device; a date when the object was captured by the machine vision device; an identification of the train car; an indication of the direction of travel of the train car; an indication of one or more train cars that are scheduled to pass through the railway environment within a predetermined amount of time, etc.

In certain embodiments, the machine vision device may communicate the alert to UE (e.g., UE 190) associated with a network operations center (e.g., network operations center 180 of FIG. 1). A user of the UE may confirm that the potential deficiency presents an actual deficiency (e.g., a safety hazard) and communicate an identification and a location of the potential deficiency to one or more components (e.g., machine vision device 150*b* of FIG. 1) of a train car (e.g., train car 140*b* of FIG. 1) that is scheduled to enter the railway environment containing the actual deficiency. As such, method 400 may be used to alert a train of an actual deficiency (e.g., a track misalignment) in an upcoming railway environment, which may allow the train to initiate an action such as stopping the train prior to encountering the track misalignment. Method 400 then moves from step 460 to step 465, where method 400 ends.

Modifications, additions, or omissions may be made to method 400 depicted in FIG. 4. Method 400 may include more, fewer, or other steps. For example, method 400 may include additional steps directed to capturing an image of a second object and analyzing the image of the second object to determine potential deficiencies. As another example, method 400 may include one or more additional steps directed to initiating one or more actions (e.g., stopping or slowing down a train) in response to receiving the alert of the potential deficiency. As still another example, method 400 may be directed to identifying exceptions (rather than potential deficiencies) in railway environment objects. As yet another example, one or more steps of method 400 may be performed in real-time.

Method 400 may be associated with any suitable transportation system (e.g., vehicles/roadways, vessels/waterways, and the like). Steps of method 400 may be performed in parallel or in any suitable order. While discussed as specific components completing the steps of method 400, any suitable component may perform any step of method 400. For example, one or more steps of method 400 may be automated using one or more components of the computer system of FIG. 4.

FIG. 5 shows an example computer system that may be used by the systems and methods described herein. For example, network 110, machine vision device 150*a*, machine vision device 150*b*, and/or UE 190 of FIG. 1 may include one or more interface(s) 510, processing circuitry 520, memory(ies) 530, and/or other suitable element(s). Interface 510 receives input, sends output, processes the input and/or output, and/or performs other suitable operation. Interface 510 may comprise hardware and/or software.

Processing circuitry 520 performs or manages the operations of the component. Processing circuitry 520 may include hardware and/or software. Examples of a processing circuitry include one or more computers, one or more microprocessors, one or more applications, etc. In certain embodiments, processing circuitry 520 executes logic (e.g., instructions) to perform actions (e.g., operations), such as generating output from input. The logic executed by processing circuitry 520 may be encoded in one or more tangible, non-transitory computer readable media (such as memory 530). For example, the logic may comprise a computer program, software, computer executable instructions, and/or instructions capable of being executed by a computer. In particular embodiments, the operations of the embodiments may be performed by one or more computer readable media storing, embodied with, and/or encoded with a computer program and/or having a stored and/or an encoded computer program.

Memory 530 (or memory unit) stores information. Memory 530 (e.g., memory 124 of FIG. 1) may comprise one or more non-transitory, tangible, computer-readable, and/or computer-executable storage media. Examples of memory 530 include computer memory (for example, RAM or ROM), mass storage media (for example, a hard disk), removable storage media (for example, a Compact Disk (CD) or a Digital Video Disk (DVD)), database and/or network storage (for example, a server), and/or other computer-readable medium.

Herein, a computer-readable non-transitory storage medium or media may include one or more semiconductor-based or other integrated circuits (ICs) (such as field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A method for identifying potential deficiencies in railway environment objects, comprising:

capturing, by a machine vision device, an image of an object in a railway environment, wherein the machine vision device is attached to a first train car that is moving in a first direction along a first railroad track of the railway environment;

analyzing, by the machine vision device, the image of the object using one or more machine vision algorithms to determine a value associated with the object;

comparing, by the machine vision device, that the value associated with the object with a predetermined threshold to determine whether the object presents an exception;

classifying, by the machine vision device, the exception as a potential deficiency;

generating, by the machine vision device, a label on the image, the label indicating the potential deficiency; and communicating, by the machine vision device, an alert indicating the exception of the object to a component external to the first train car, the alert comprising the labeled image.

2. The method of claim 1, wherein the potential deficiency of the object is one of the following:

a misalignment of a second railroad track;

a malfunction of a crossing warning device;

an obstructed view of a second railroad track;

damage to the object; and a misplacement of the object.

3. The method of claim 1, wherein the predetermined threshold is a predetermined acceptable value.

4. The method of claim 1, wherein the component external to the first train car is a device located within a network operations center.

5. The method of claim 1, wherein the analyzing the image of the object includes:

determining a track misalignment value for the first railroad track that extends a first distance.

6. The method of claim 5, wherein the comparing the value associated with the object with a predetermined threshold includes:

comparing the track misalignment value with an acceptable track misalignment value for a second railroad track extending a second distance to determine whether the track misalignment of the first track presents an exception.

7. The method of claim 1, wherein the analyzing the image of the object includes:

determining a debris value indicating that debris is located proximate the first railroad track.

8. The method of claim 7, wherein the comparing the value associated with the object with a predetermined threshold includes:

comparing the debris value with an acceptable value of debris located a first distance away from the first railroad track to determine whether the debris presents an exception.

9. The method of claim 1, wherein the analyzing the image of the object includes:

determining a pedestrian value indicating that a pedestrian is located proximate the first railroad track.

10. The method of claim 9, wherein the comparing the value associated with the object with a predetermined threshold includes:

comparing the pedestrian value with an acceptable value of a pedestrian located an acceptable distance away from the first railroad track to determine whether the pedestrian presents an exception.

11. A method for identifying potential deficiencies in railway environment objects, comprising:

capturing, by a machine vision device, an image of an object in a railway environment, wherein the machine vision device is attached to a first train car that is moving in a first direction along a first railroad track of the railway environment;

analyzing, by the machine vision device, the image of the object using one or more machine vision algorithms to determine a value associated with the object;

comparing, by the machine vision device, that the value associated with the object with a predetermined threshold to determine whether the object presents an exception; and classifying, by the machine vision device, the exception as a potential deficiency;

generating, by the machine vision device, a label on the image, the label indicating the potential deficiency; and communicating, by the machine vision device, an alert indicating the exception of the object to a component external to the first train car, wherein the alert includes a description of the object and an identification of the first train car, the alert comprising the labeled image.

12. The method of claim 11, wherein the potential deficiency of the object is one of the following:

a misalignment of a second railroad track;

a malfunction of a crossing warning device;

an obstructed view of a second railroad track;

damage to the object; and a misplacement of the object.

13. The method of claim 11, wherein the predetermined threshold is a predetermined acceptable value.

14. The method of claim 11, wherein the component external to the first train car is a device located within a network operations center.

15. The method of claim 11, wherein the analyzing the image of the object includes:

determining a track misalignment value for the first railroad track that extends a first distance.

16. The method of claim 15, wherein the comparing the value associated with the object with a predetermined threshold includes:

comparing the track misalignment value with an acceptable track misalignment value for a second railroad track extending a second distance to determine whether the track misalignment of the first track presents an exception.

17. The method of claim 11, wherein the analyzing the image of the object includes:

determining a debris value indicating that debris is located proximate the first railroad track.

18. The method of claim 17, wherein the comparing the value associated with the object with a predetermined threshold includes:

comparing the debris value with an acceptable value of debris located a first distance away from the first railroad track to determine whether the debris presents an exception.

19. The method of claim 11, wherein the analyzing the image of the object includes:

determining a pedestrian value indicating that a pedestrian is located proximate the first railroad track.

20. The method of claim 19, wherein the comparing the value associated with the object with a predetermined threshold includes:

comparing the pedestrian value with an acceptable value of a pedestrian located an acceptable distance away from the first railroad track to determine whether the pedestrian presents an exception.

* * * * *